United States Patent [19]

Schambeck

[11] Patent Number: 4,589,156

[45] Date of Patent: May 20, 1986

[54] SUPPORT STRUCTURE, PARTICULARLY FOR A LONG SPAN BRIDGE

[75] Inventor: Herbert Schambeck, Frieding/Andechs, Fed. Rep. of Germany

[73] Assignee: Dyckerhoff & Widmann Aktiengesellschaft, Munich, Fed. Rep. of Germany

[21] Appl. No.: 696,787

[22] Filed: Jan. 31, 1985

[30] Foreign Application Priority Data

Jan. 31, 1984 [DE] Fed. Rep. of Germany ..... 3403140

[51] Int. Cl.[4] ..... E01D 7/00; E01D 7/02; E01D 19/00

[52] U.S. Cl. ..... 14/4; 14/75; 52/655

[58] Field of Search ..... 14/3, 4, 6–8, 14/13, 17, 24, 73, 75, 1; 52/87, 226, 639, 655; 104/123–125

[56] References Cited

FOREIGN PATENT DOCUMENTS 2105390 3/1983 United Kingdom ..... 14/6

OTHER PUBLICATIONS

Engineering News Record, "Thin-Section Concrete Arches as Built in Switzerland", FIGS. 1 & 2, Jan. 11, 1934.

Engineering News Record, "Bids on California Bridge Job Showed Shop Fabrication Cheaper", Sept. 2, 1948.

*Primary Examiner*—James A. Leppink
*Assistant Examiner*—John F. Letchford
*Attorney, Agent, or Firm*—Toren, McGeady, Stanger, Goldberg & Kiel

[57] ABSTRACT

A support structure, such as a bridge support structure for long spans between supports, includes a beam-like girder formed of reinforced concrete or prestressed concrete connected to and supported on the upper ends of support piers so that the girder is bending resistant. A strut framework extends between the girder and the support pier and includes a reinforced concrete compression strut extending diagonally upwardly from the lower end of the support pier to the girder at a position spaced outwardly from the support pier whereby the dead load of the compression strut is supported by tie rods extending from the compression strut upwardly to the girder or the pier. The compression strut forms one side of a triangle with the other sides formed by the girder and the support with the tie rods located within the triangle.

14 Claims, 5 Drawing Figures

S
S
II
II
IV
IV
V
V
1
2
3
4
5
6
6'
7
8
9
10

SUPPORT STRUCTURE, PARTICULARLY FOR A LONG SPAN BRIDGE

BACKGROUND OF THE INVENTION

The present invention is directed to a support structure, particularly for use in a bridge structure, where a beam-like girder of steel reinforced concrete or prestressed concrete is supported on the upper ends of support piers so that it is bending resistant and, in addition, the girder is supported by a strut framework including diagonally extending compression struts of reinforced concrete.

Experience has shown where bridge roadway structures formed of prestressed concrete and spanning lengths of 250 m or more between supports and not supported by suspension members, such as in suspension bridges or cable-stayed bridges, that problems develop as compared to the methods developed and proven for smaller bridge spans up to 250 m. Such problems are especially noted when the bridge towers extending above the roadway, which permit the use of diagonal bracing, are to be avoided.

A strut framework is a static system which has been used in timber structures and has also found use in certain reinforced concrete structures. A strut framework is a type of truss in which the roadway girder spanning support piers is supported relative to the piers by diagonally extending compression struts of reinforced concrete extending between the girder and the pier. Such diagonal compression struts must be able to withstand axial compression loads in their long direction, and also bending loads as a result of the inherent dead weight of the strut. Accordingly, when the combination of bending loads are taken with axial loads, considering the buckling factor, the dimensioning of the strut becomes critical. Due to the dimensioning of such compression struts based on their loading, and in view of the requirements of reinforced concrete construction, the struts must extend relatively steeply from the roadway girder to the support pier with the result that the strut can not effectively increase the span length or the strut must be constructed with a large cross-section, in particular when viewed from the side of the bridge for absorbing the dead load bending moment. Accordingly, compression struts extending steeply from the roadway girder are not very effective and, furthermore, such struts with a large dimension as viewed from the side of the bridge, result in a considerable dead weight and have a disadvantageous effect on the aesthetic appearance of the bridge structure.

SUMMARY OF THE INVENTION

Therefore, the primary object of the present invention is to provide a strut framework which overcomes the known problems and affords an effective support for long span bridge structures.

In accordance with the present invention, the diagonal compression struts are suspended from the bridge roadway girder and/or the support piers by tie members or rods acting in tension.

The basic concept of the invention is to conduct the dead load of the compression struts via the tie rods directly to the bridge structure so that downward buckling of the compression struts is prevented. Simple tie rods are sufficient for attachment to the compression struts, since any upward buckling or displacement of the compression struts is prevented due to their dead weight.

As desired, the tie rods can be adapted to both static and constructional requirements. The tie rods may be formed as reinforced concrete members, however, they can also be provided as simple steel tie rods or tie bars formed of individual steel elements arranged in a tubular sheathing for protection against corrosion and enclosed within the sheathing by a hardenable material, such as grout, subsequently injected into the sheathing.

It is possible, according to the invention, to construct the compression struts as solid members without great bending resistance in the vertical direction, that is, in the form of flat rectangular cross-section members providing a slender effect when viewed from the side of the bridge so that the aesthetic appearance of the structure is emphasized, while lateral buckling is prevented.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figures 1, 2, 3, 4, 5:
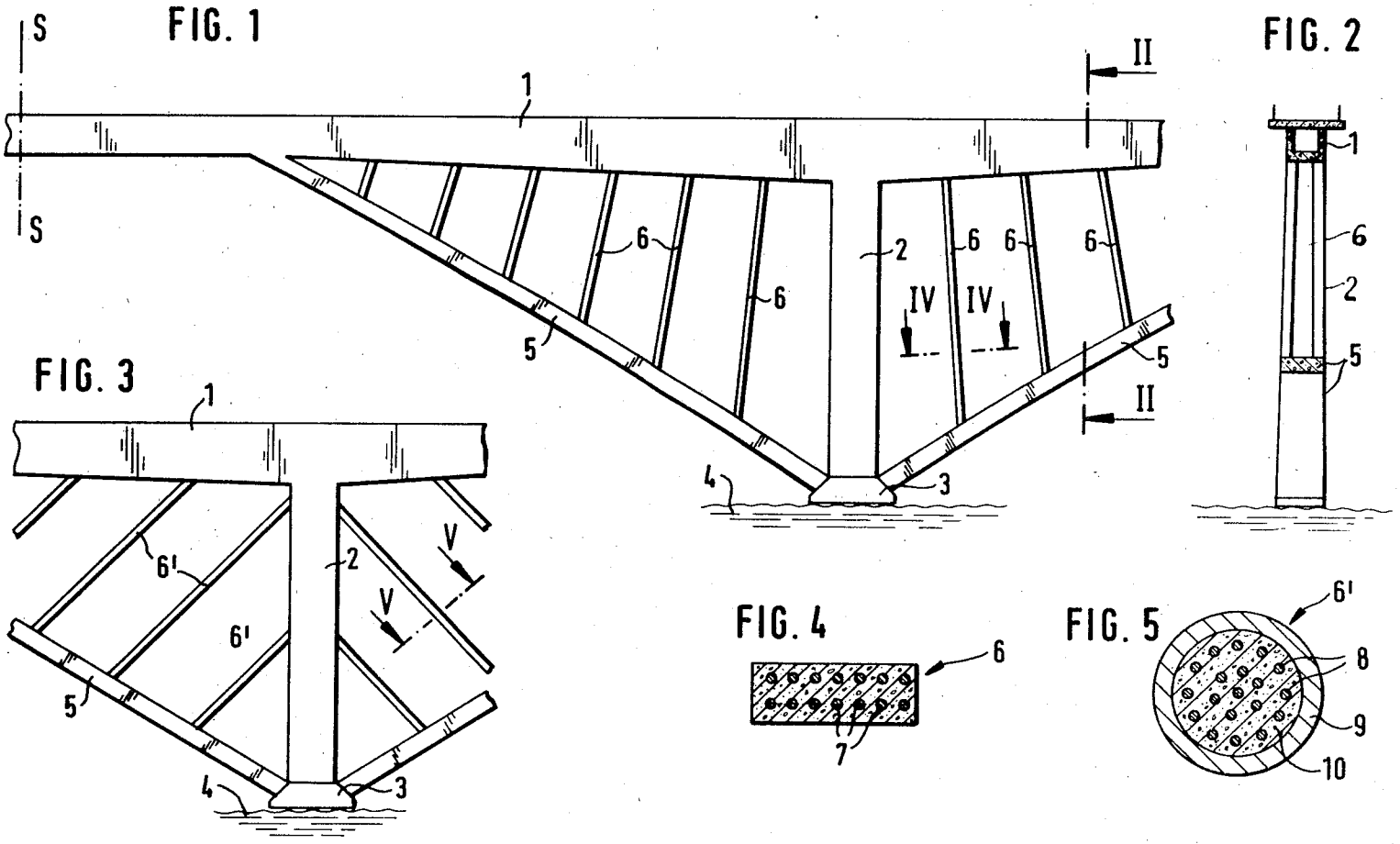
FIG. 1 is a partial side view of a bridge structure incorporating the supporting framework according to the present invention.
FIG. 2 is a cross-sectional view taken along the line II—II in FIG. 1.
FIG. 3 is a partial side view, similar to FIG. 1, showing another embodiment of the supporting framework of the present invention.
FIG. 4 is a cross-sectional view taken along the line IV—IV in FIG. 1.
FIG. 5 is a cross-sectional view taken along the line V—V in FIG. 3.

FIG. 1 illustrates only a part of a bridge and its supporting framework, embodying the present invention, shown in the region of a center support pier 2 illustrated in side view in FIG. 1 while FIG. 2 provides a cross-sectional view of the supporting framework at a location spaced from the pier. As can be noted in FIG. 2, the bridge roadway girder 1 is in the form of a box girder supported on the upper end of the support pier 2 with the lower end of the pier resting on a foundation 3. The bridge may span a body of water with a level 4 shown in the region of the foundation 3. The bridge is symmetrical at least in its central region and has a vertical axis of symmetry S—S shown in the left-hand portion of FIG. 1.

The roadway girder 1 extends generally horizontally outwardly from both sides of the support pier 2 which extends vertically upwardly from the foundation 3. A rectilinear diagonal compression strut 5 is located on each of the opposite sides of the foundation 3 and extends rectilinearly upwardly from the foundation to the roadway girder at a location spaced considerably outwardly from the pier 2 but short of the axis of symmetry. As can be seen in FIG. 2, the compression strue 5 has a flat rectangular cross-section and is formed of reinforced concrete. Each strut 5 forms one side of a triangle with the other sides formed by the roadway girder 1 and the support pier 2. Within the triangle each compression strut is suspended, as viewed in FIG. 1, by tie rods 6 extending downwardly from the roadway girder 1. The tie rods extend generally vertically and are approximately uniformly spaced between the support pier 2 and the junction of the strut 5 with the roadway girder 1. To carry the additional load resulting from the supporting framework, the depth of the girder 1 is increased from the point of connection of the strut 5 with the girder 1 to the position where the girder is connected to and supported on the upper end of the pier 2.

In FIG. 3 another embodiment of the supporting framework is shown where the tie rods 6' extend at an acute angle relative tO the vertical with some of the rods 6' extending between the compression strut 5 and the pier 2 with the remaining tie rods extending between the compression strut 5 and the roadway girder 1. As in the arrangement shown in FIG. 1, the tie rods 6' are approximately equidistantly spaced from one another within the triangle defined by the compression strut 5, the roadway girder 1 and the support pier 2.

The tie members or rods 6, 6' can be constructed as desired, since it is only necessary that they absorb axial tensile forces. In FIGS. 4 and 5 examples are shown of possible cross-sectional constructions of the tie rods. In FIG. 4, a cross-sectional view taken along the line IV—IV in FIG. 1 displays a tie member 6 of rectangular cross-section formed of reinforced concrete with steel reinforcing bars 7. In FIG. 5, the cross-sectional view taken along the line V—V in FIG. 3, the tie rods 6' are made up of a plurality of individual steel elements 8 located within a tubular sheathing 9 formed of plastics material or of steel with the elements enclosed within a hardenable material 10, such as cement grout, which can be subsequently injected into the sheathing.

As viewed from the side of the bridge, that is, as in FIGS. 1 and 3, the tie members or rods 6, 6' have a slender appearance which enhances the aesthetic appearance of the bridge structure.

The invention is not limited to the bridge construction illustrated in the drawing, rather it may be incorporated in a similar manner in other superstructure and support pier arrangements.

While specific embodiments of the invention have been shown and described in detail to illustrate the application of the inventive principles, it will be understood that the invention may be embodied otherwise without departing from such principles.

I claim:

1. A support structure, such as for a long span bridge structure, comprising an elongated generally horizontally extending beam-like girder with said girder being formed of reinforced concrete or prestressed concrete and having a pair of spaced ends and being symmetrical about a vertical axis of symmetry between the ends thereof, at least one upright support pier for one end of said girder so that said girder is bending resistant, said support pier having an upper end connected to and supporting said girder and a lower base end, and a strut framework comprising an elongated rectilinear compression strut connected at one end to said girder at a position spaced outwardly from the upper end of said support pier and connected at the other end to said support pier adjacent the lower end thereof so that said compression strut extends diagonally and rectilinearly between said generally horizontal girder and said support pier, said compression strut is formed of reinforced concrete, and elongated tie members each connected at one end to said compression strut at spaced positions between said support pier and said girder and extending upwardly therefrom and connected at the other end to one of said girder or support pier.

2. A support structure, as set forth in claim 1, wherein said tie members are formed of reinforced concrete.

3. A support structure, as set forth in claim 2, wherein said tie members extend generally vertically upwardly from said compression strut to the underside of said girder.

4. A support structure, as set forth in claim 2, wherein said compression strut has a rectangular cross-section with two narrow sides and two longer sides.

5. A support structure, as set forth in claim 1, wherein said tie members each consist of a tie rod formed of a plurality of steel elements, a tubular sheathing laterally enclosing said steel elements, and a hardenable material injectable into said tubular sheathing for laterally enclosing said steel elements within said sheathing.

6. A support structure, as set forth in claim 5, wherein said steel elements are steel rods.

7. A support structure, as set forth in claim 5, wherein said steel elements are stranded steel members.

8. A support structure, as set forth in claim 5, wherein said tie members extend obliquely of the vertical and at least certain of said tie members extend between said compression strut and said support pier and the remaining said tie members extend between said compression strut and said girder.

9. A support structure, such as a bridge support structure for very long spans between supports in the range of 250 m or more, comprising an elongated generally horizontal beam-like girder with said girder being formed of reinforced concrete or prestressed concrete, said girder having a pair of spaced ends and being symmetrical about a vertical axis of symmetry between the ends thereof, upright support piers for said girder spaced apart in the elongated direction of said girder and said support piers being formed of reinforced concrete, said support piers having an upper end and lower end, the ends of said girder being connected to the upper ends of a pair of adjacent said support piers so that said girder is bending resistant, a strut framework arranged symmetrically on each of the opposite sides of said support piers for supporting said girder, each said strut framework comprises an elongated rectilinear compression strut connected at one end to said girder at a position spaced between said support pier and the axis of symmetry and at the other end to said support pier adjacent the lower end thereof so that said compression strut extends diagonally and rectilinearly between said generally horizontal girder and said support pier, said compression strut is formed of reinforced concrete, and a plurality of elongated tie members spaced apart along the elongated direction of said compression strut and each tie member connected to and extending between said compression strut and one of said girder or said support pier.

10. A support structure, as set forth in claim 9, wherein each said support pier includes a foundation at the lower end thereof and said compression struts extending between said foundation and said girder.

11. A support structure, as set forth in claim 9, wherein said girder is a box girder.

12. A support structure, as set forth in claim 9, wherein the combination of said compression strut, said support pier and said girder define a triangle with said tie members located within said triangle.

13. A support structure, as set forth in claim 12, wherein said tie members extend approximately vertically between said compression strut and said girder.

14. A support structure, as set forth in claim 12, wherein said tie members located within said triangle extend obliquely to the vertical with at least one of said tie members extending between said compression strut and said support pier and the remaining said tie members extending between said compression strut and said girder.

* * * * *